US008317083B2

(12) United States Patent
Specht

(10) Patent No.: US 8,317,083 B2
(45) Date of Patent: Nov. 27, 2012

(54) CASH DRAWER WITH CONTROLLED ACCESS SECURITY COMPARTMENT

(75) Inventor: Paul E. Specht, Glenview, IL (US)

(73) Assignee: Block and Company, Inc., Wheeling, IL (US)

( * ) Notice: Subject to any disclaimer, the term of this patent is extended or adjusted under 35 U.S.C. 154(b) by 0 days.

(21) Appl. No.: 12/885,758

(22) Filed: Sep. 20, 2010

(65) Prior Publication Data

US 2012/0068588 A1 Mar. 22, 2012

(51) Int. Cl.
*G07G 1/00* (2006.01)

(52) U.S. Cl. ..... 235/7 R; 235/10

(58) Field of Classification Search ..... 235/7 R, 235/10, 12, 17

See application file for complete search history.

(56) References Cited

U.S. PATENT DOCUMENTS

| | | | | |
|---|---|---|---|---|
| 1,349,527 | A | 8/1920 | Owen | |
| 1,754,911 | A | 4/1930 | Sherwood et al. | |
| 2,594,653 | A | 4/1952 | Jertson | |
| 4,638,908 | A | 1/1987 | Baitz et al. | |
| 4,786,765 | A * | 11/1988 | Yamanami et al. | 178/19.06 |
| 5,371,344 | A * | 12/1994 | Buie et al. | 235/1 R |
| 5,768,965 | A * | 6/1998 | Gonzalez et al. | 83/440 |
| 7,059,513 | B2 * | 6/2006 | Daugs et al. | 235/10 |

* cited by examiner

*Primary Examiner* — Daniel St Cyr
(74) *Attorney, Agent, or Firm* — Cook Alex Ltd.

(57) ABSTRACT

A cash drawer having a secured storage compartment accessible from the front when the drawer is closed or open is disclosed. The storage compartment includes a cover and bottom tray, the forward upper ends of which are upwardly positioned to define a chute which is in communication with a slot in the cash drawer front plate for depositing items such as, for example, large denomination paper currency into the storage compartment. Controlled access to the compartment is provided by a suitable lock such as, for example, a dead bolt key lock.

17 Claims, 5 Drawing Sheets

CASH DRAWER WITH CONTROLLED ACCESS SECURITY COMPARTMENT

FIELD OF THE INVENTION

This invention generally relates to cash drawers and, in particular, to controlled access security compartments in cash drawers.

BACKGROUND OF THE INVENTION

Cash drawers, particularly those positioned at point-of-sale locations, commonly include a removable till which overlies and conceals a storage area wherein a variety of items may be stored. Such items may include, for example, large denomination paper currency, checks, credit and debit card transaction records, and the like. Deposit of such items into this storage area typically requires the user to at least partially remove of the till from the cash drawer and thus expose the contents of this storage area. Apart from the inefficiency of this procedure, the visibility of the valuable contents which can, in the case of large-denomination paper currency, increase the potential for theft or so-called cash shrinkage.

SUMMARY OF THE INVENTION

The cash drawer of the present invention provides a secured storage compartment which is accessible from the cash drawer front, allowing the deposit therein of items such as, for example, paper currency, checks, credit and debit card transaction records, irrespective of whether the cash drawer is open or closed.

In accordance with another aspect of the invention, when the cash drawer is opened and the till removed therefrom, the contents of the secured compartment are concealed so that the amount and nature thereof is not readily discernable to an observer at the point-of-sale location. Moreover, controlled access to the contents is provided by a locked cover plate which can be removed only by those persons having the proper unlocking device such as a key or combination for the lock.

These and other features of this invention will be apparent from the following detailed description of a preferred embodiment thereof as shown in the accompanying drawings wherein like reference numerals indicate corresponding parts throughout.

DETAILED DESCRIPTION OF THE PREFERRED EMBODIMENT

Figure 1:
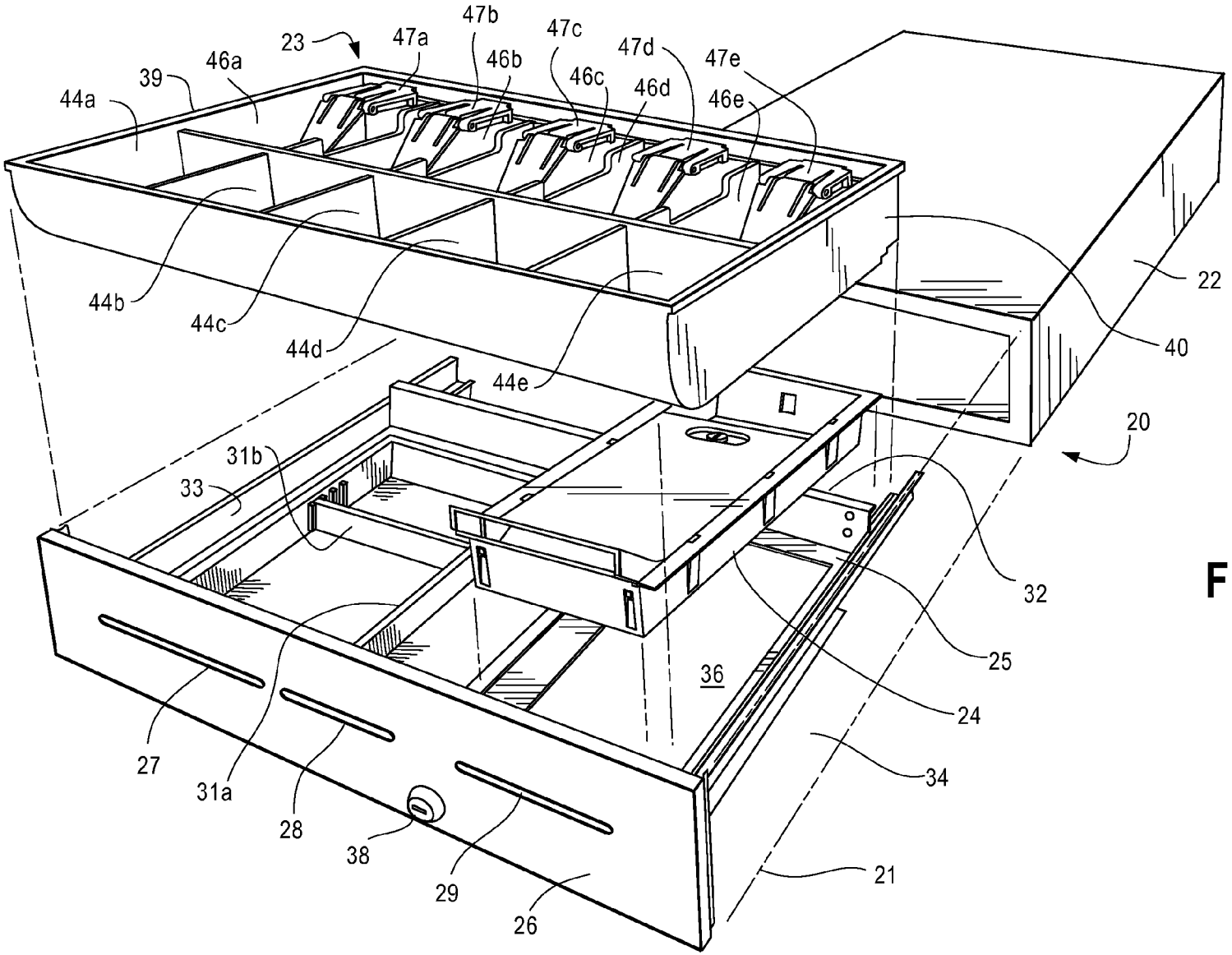
FIG. 1 is an exploded perspective view of a cash drawer showing a till spaced-away, in overlying relation to an embodiment of the secured storage compartment of the present invention which, in turn, is in spaced-away, overlying relationship to the cash drawer.

Referring to the drawings, in particular to FIG. 1, the reference numeral 20 generally designates a cash drawer assembly which includes a drawer which is slidably received in a housing 22 for reciprocal movement between open and closed positions. The illustrated cash drawer and respective parts are constructed of steel and plastic; however, it is appreciated that they may be constructed of any suitable material such as other metals, composites or the like. As shown, a till 23 is sized to be removably received within the drawer. Till 23 can be of conventional construction, however, a particularly suitable till construction for use within the present invention is that shown and claimed in co-owned U.S. Pat. No. 7,731,008 entitled "Global Till" which is incorporated herein by reference in its entirety.

Figure 10:
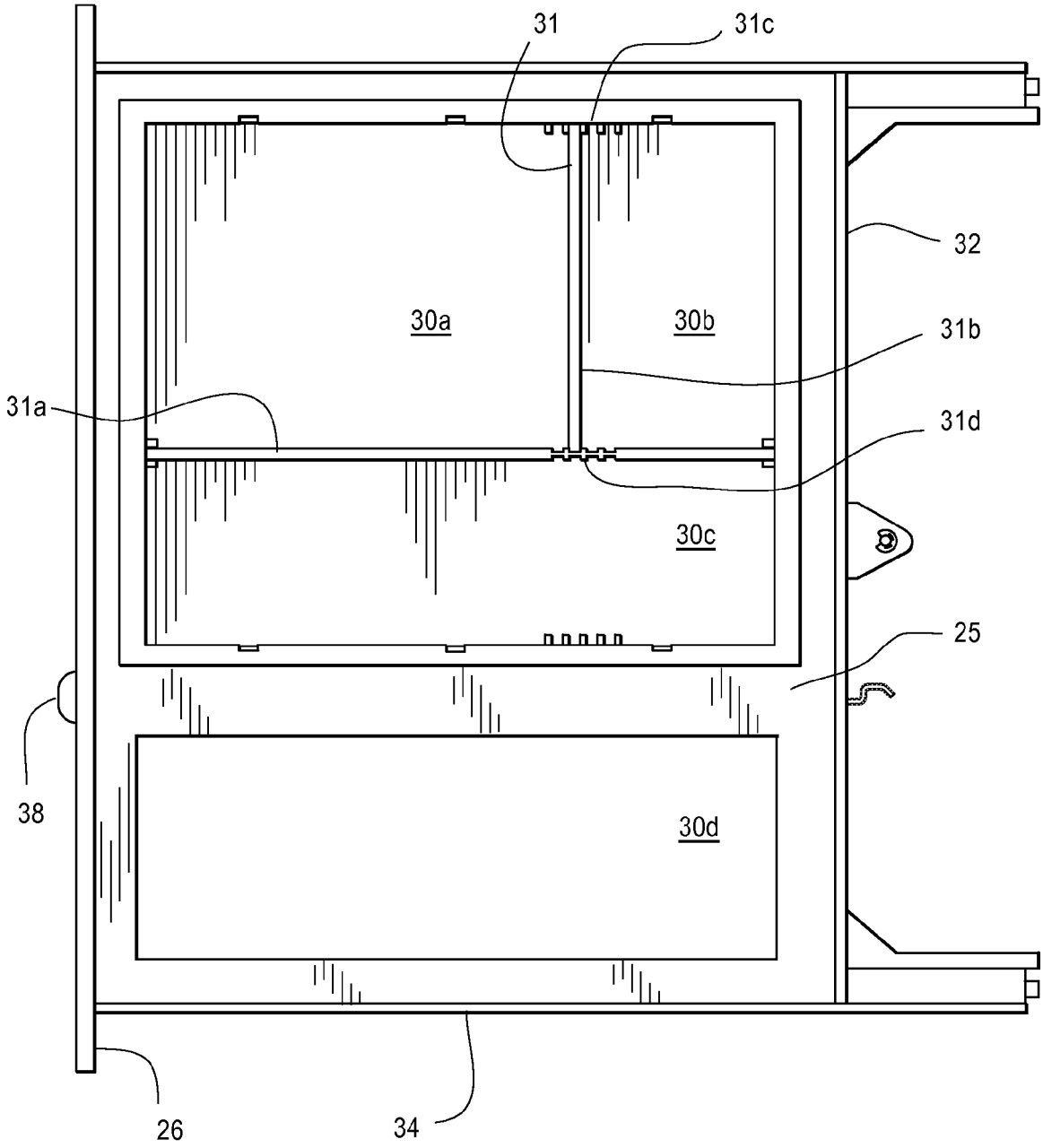
FIG. 10 is a top plan view of the cash drawer with the secured storage compartment removed.
Figure 11:
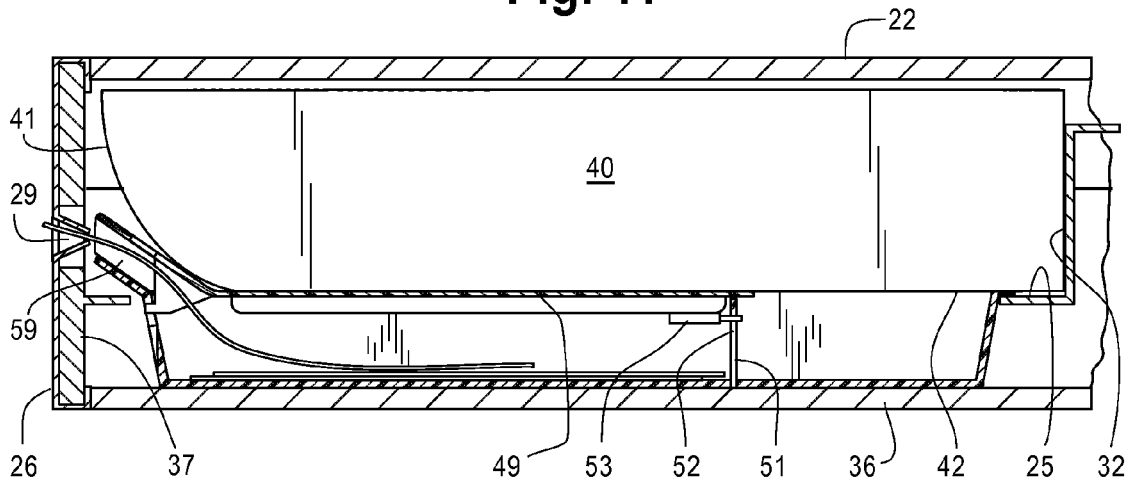
FIG. 11 is a side elevational view, partially in section, showing the till in overlying relationship to the secured storage compartment with an item of paper currency being deposited therein.

As best shown in FIGS. 1 and 11, the till 23 is received on a support surface 25 and overlies a secured storage compartment 24. A front plate 26 of the cash drawer is provided with a plurality of access slots 27, 28 and 29 respectively provide access to separate storage areas below the till when it is positioned in the cash drawer. It will be appreciated that the number of access slots and placement may be altered without departing from the spirit and scope of the invention. In the illustrated embodiment, the storage area is selectively divided into subcompartments for storing a variety of items including paper currency, checks, credit and debit card transaction records, spare coin rolls and the like. For example, as best shown in FIG. 10, a large storage area in the area below the till can be selectively subdivided into subcompartments 30*a*, 30*b* and 30*c* by a longitudinal partition 31*a* and a transverse partition 31*b*. As shown, transverse partition or tray divider 31*b* are selectively movable such that it is positionable between any of four opposed pairs of ribs generally designated by reference numbers at 31*c* and 31*d* selectively vary the size of subcompartments 30*a* and 30*b*. A similar movable transverse partition or tray divider can be provided in subcompartment 30*c* to likewise divide that subcompartment into two separate sections, making the rear sections particularly suitable for storing coin rolls. It will be appreciated that the large storage area can be subdivided using a variety of other components and/or methods.

As best shown in FIGS. 1, 10 and 11, cash drawer 21 includes a backwall 32, a pair of sidewalls 33, 34, a bottom wall 36 and a front wall 37. Desirably, the drawer is provided with a lock and more specifically a key lock 38 for securing the drawer in a closed position when such is desired. Other locks, such as a combination lock, a tubular lock, a biometric lock, or the like may be used and not depart from the spirit or scope of the invention.

Till 23 includes a pair of sidewalls 39, 40, a curved front wall 41, a bottom wall 42 and a back wall 43. Subdividing partitions as shown in FIG. 1 are provided to define a plurality of coin compartments 44*a*-44*e* and a plurality of paper currency compartments 46*a*-46*e*, each of which are respectively provided with bill weights 47*a*-47*e*. As described in U.S. Pat. No. 7,731,008, the till can be selectively reconfigured to receive paper currencies and coins of various sizes and denominations. As previously mentioned, U.S. Pat. No. 7,731,008 is incorporated herein by reference in its entirety.

In the illustrated embodiment of the present invention, the secured storage compartment 24 includes a bottom tray 48 and cover 49. Bottom tray 48 has peripheral flanges 48*a*, 48*b* and 48*c* which are sized to be received in a subcompartment section 30*d*, best shown in FIG. 10. The sidewalls of 48*a* and 48*c* include a plurality of flexible tabs 48*d* which are sized to cooperate with the perimeter of the support shelf surrounding subcompartment area 30*d* to provide a snap fit for securing the tray to the support shelf so that it cannot be readily removed from the cash drawer 21.

Bottom tray 48 includes a front wall 50 having an inclined upper portion 50*a* which is sized and positioned so that it is immediately below the slot 29 of front plate 26. A transverse partition 51 is preferably fixed to the sidewalls of 48*e* and 48*f* and includes a latch-receiving aperture 52 of a dead bolt (not shown) of a key lock 53 in the cover plate 49. It will of course be appreciated that other locking devices such as, for example, a combination lock, tubular lock, biometric lock or padlock may be substituted for the key lock 53 to provide controlled access to the contents of storage compartment 24

Figure 2:
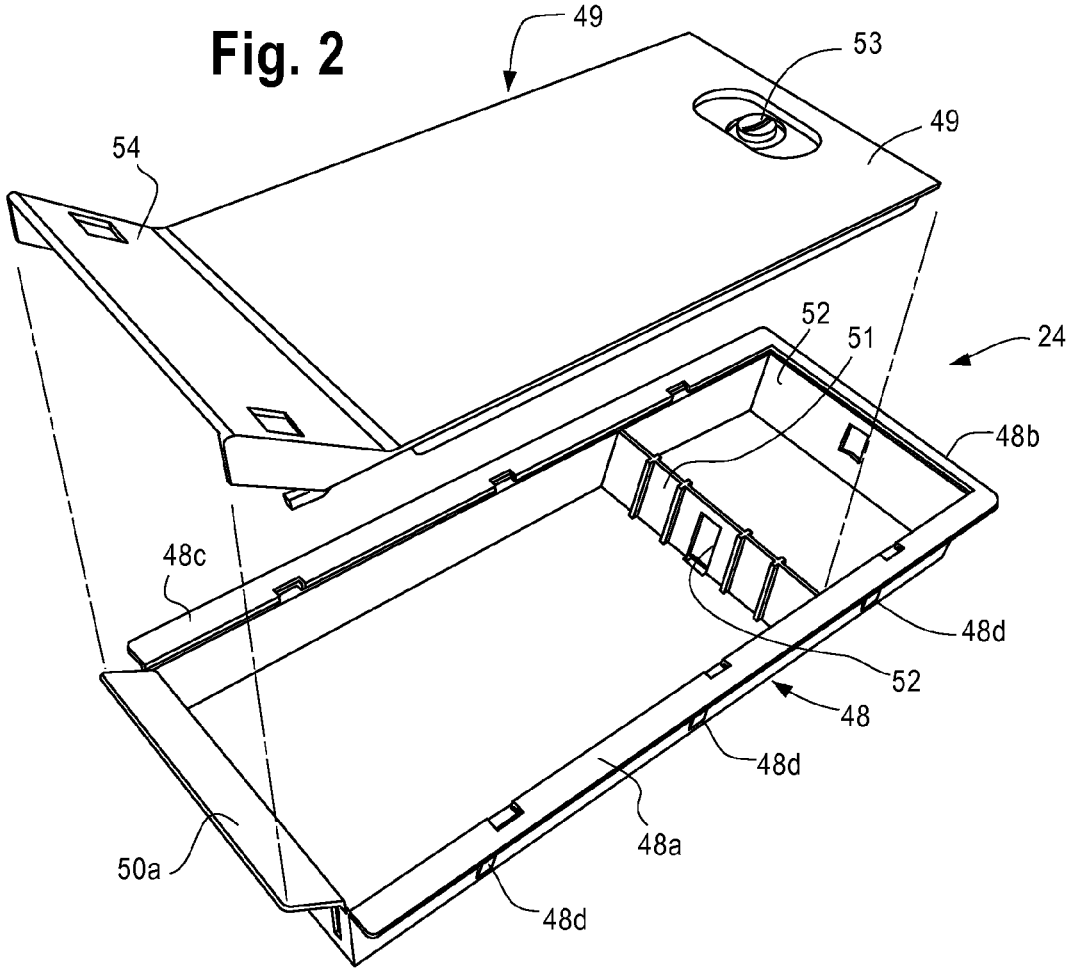
FIG. 2 is an exploded perspective showing the secured storage compartment of FIG. 1 with the cover thereof in spaced-away, overlying relation to the tray portion.
Figure 3:
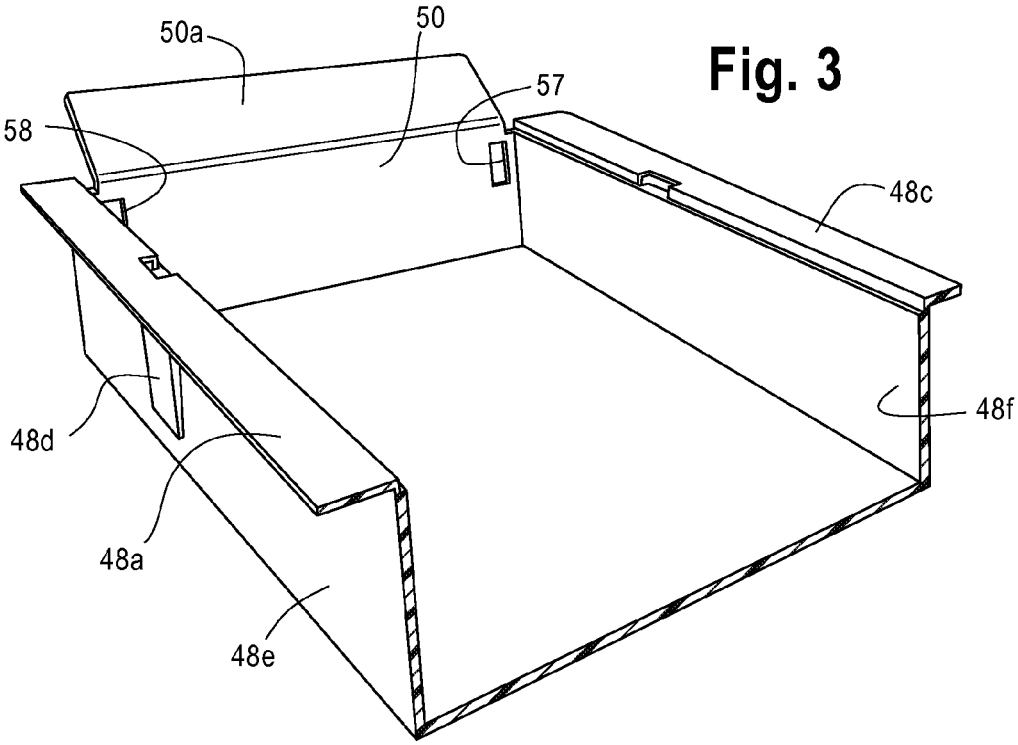
FIG. 3 is a partial fragmentary perspective of the tray shown in FIG. 2.
Figure 4:
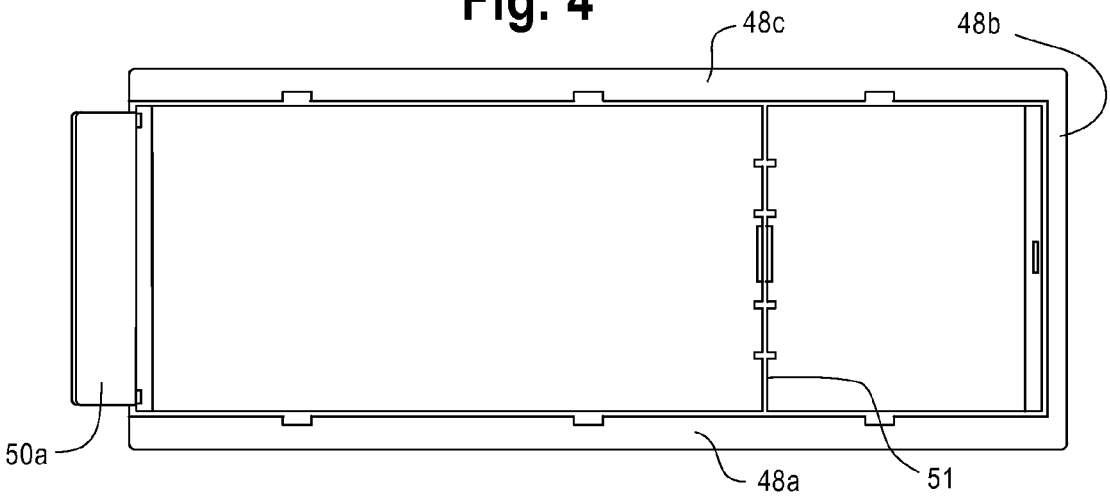
FIG. 4 is a top plan view of the secured storage compartment tray with the cover removed.
Figure 5:
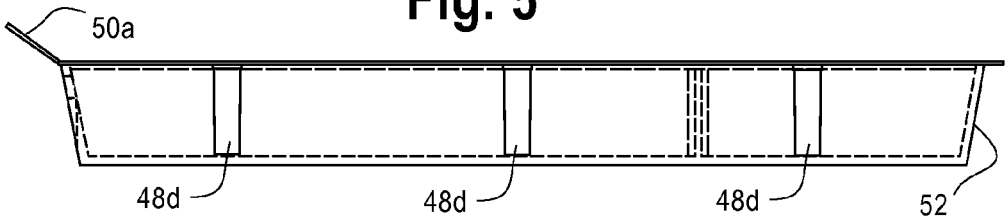
FIG. 5 is a side elevational view of the secured storage compartment shown in FIG. 4 with portions thereof shown in phantom.
Figure 6:
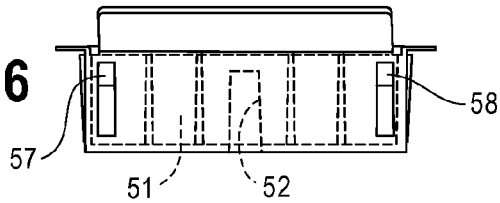
FIG. 6 is a front elevational view, partially in section of the storage compartment tray shown in FIGS. 3-5.
Figure 8:
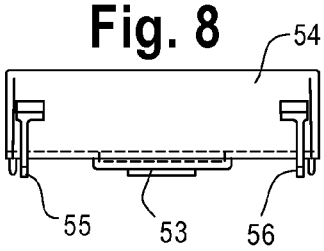
FIG. 8 is a front elevational view of the cover plate shown in FIG. 7.
Figure 7:
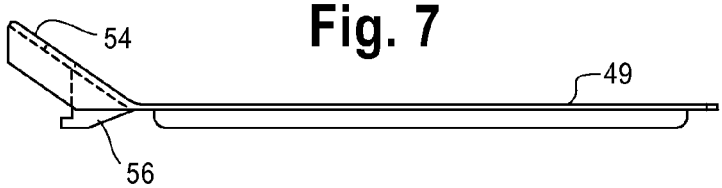
FIG. 7 is a side elevational view of the cover plate of the secured storage compartment shown in FIG. 2.
Figure 9:
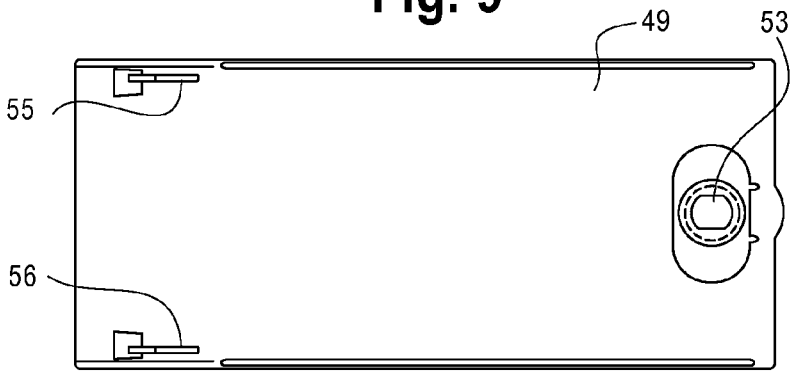
FIG. 9 is a top plan view of the cover plate shown in FIG. 7.
Figure 12:
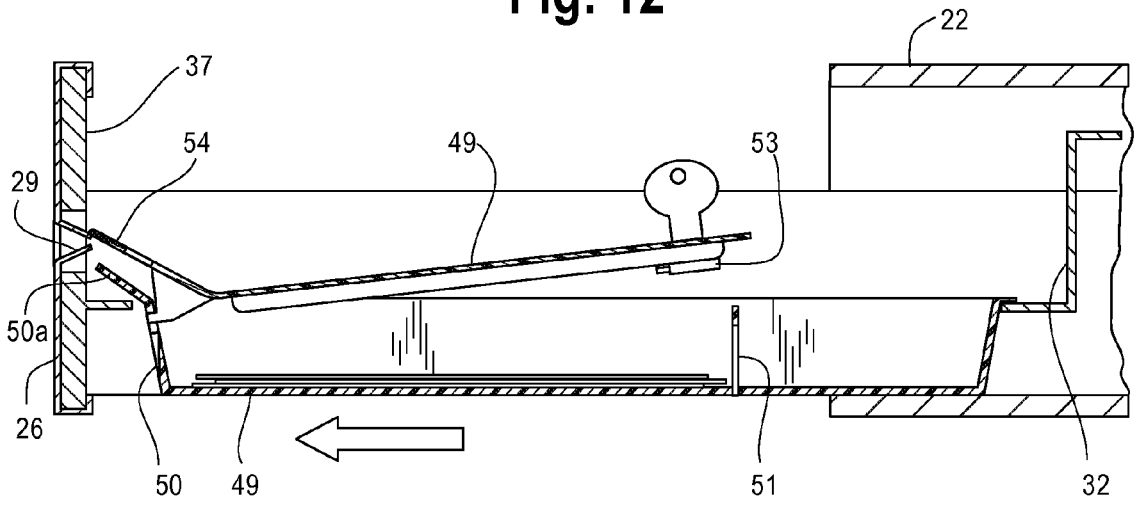
FIG. 12 is a side elevational view, partially in section, of the cash drawer with the till removed and the cover plate in a pivoted and unlocked position.

As best shown in FIGS. 2, 7 and 9, cover plate 49 is sized to overlay and enclose the bottom tray 48 and includes an upwardly inclined forward end 54 which cooperates with the inclined upper portion 50*a* of bottom tray forward wall 50 to define a chute 59 for guiding items which are passed through slot 29 into the interior of the secured storage compartment. Cover plate has a pair of lugs 55, 56 which are respectively received in slots 57, 58 of the bottom tray 48. This arrangement permits the cover plate to be totally removed or only upwardly pivoted as shown in FIG. 12 when access to the interior of the storage compartment as desired. However, it will be appreciated the cover plate may be attached to the bottom tray via other means, for example, a hinge or the like. In addition, the attachment may be made on any selected side(s) of the bottom tray.

As shown in FIG. 11, items (for example, large denomination paper currency) can be deposited into the storage compartment 24 when the cash drawer 21 is closed via passage of such items through slot 29 and chute 59 and into the interior of the locked and enclosed storage compartment. Removal of the contents from the storage compartment can be accomplished as shown in FIG. 12 by removal of till from the open cash drawer, unlocking key lock 53 and upwardly pivoting cover plate 49 or alternatively, if desired, the cover plate can be separated from bottom tray 48.

Although the subject cash drawer and controlled access security compartment have been disclosed and described in a preferred form with particularity, it will be understood that various modifications and changes may be made to the details thereof without departing from the spirit and scope of this invention as hereinafter claimed.

The invention claimed is:

1. A cash drawer having a secured storage compartment accessible from the front when the drawer is closed for receiving items to be stored therein and providing controlled access to the interior thereof for selective removal of said items, comprising:

a housing;

a cash drawer received in said housing and moveable therein between closed and open positions, said cash drawer including a frontwall, a pair of sidewalls, a backwall, and a bottom panel;

a support surface in said cash drawer;

a till received on said support surface, said till having a bottom surface which extends forwardly from a backwall to a curved portion which terminates in a generally horizontal front edge;

a storage area in said cash drawer between the bottom surface of said till and the cash drawer bottom panel;

at least one security compartment in said storage area;

a front plate mounted on the outer surface of said front wall, said front plate having a horizontal slot formed therein, said slot providing access to said security compartment when said cash drawer is in a closed position;

a cover plate overlying and enclosing said security compartment; and, a lock on said cover plate for controlling access to said security compartment when said till is removed from said support surface.

2. The cash drawer of claim 1 wherein said cover plate has an upwardly inclined front portion that extends forwardly from a generally flat horizontal portion that overlies and encloses said security compartment, said inclined front portion cooperating with said horizontal slot to direct items passed through said slot into said enclosed security compartment.

3. The cash drawer of claim 2 wherein a frontwall of said security compartment has an upwardly inclined forward portion generally parallel to the upwardly inclined front portion of said cover plate forming a downwardly inclined passageway from said horizontal slot that communicates with the interior of said security compartment.

4. The cash drawer of claim 3 wherein said frontwall of said security compartment has a lower portion that extends upwardly from the bottom panel, said lower portion including a pair of slots sized and spaced to receive a pair of lugs on a lower surface of said inclined front portion of said cover plate.

5. The cash drawer of claim 4 wherein said cover plate is pivotally connected to the frontwall of said security compartment.

6. The cash drawer of claim 4 wherein said cover plate is detachably connected to said frontwall of said security compartment.

7. The cash drawer of claim 1 wherein said lock is a key lock.

8. The cash drawer of claim 1 wherein said security compartment. includes a transverse rearwall having a slot therein for receiving a deadbolt of said key lock.

9. The cash drawer of claim 1 wherein the security compartment has an interior width generally corresponding to the width of said horizontal slot.

10. A cash drawer having a secured storage compartment accessible from the front when the drawer is closed for receiving items to be stored therein and providing controlled access to the interior thereof for selective removal of said items, comprising:

a housing;

a cash drawer received in said housing and moveable therein between closed and open positions, said cash drawer including a frontwall, a pair of sidewalls, a backwall, and a bottom panel;

a support surface in said cash drawer;

a till removably received on said support surface, said till having a bottom surface which extends forwardly from a back wall to a curved portion which terminates in a generally horizontal front edge;

a storage area in said cash drawer between the bottom surface of said till and the cash drawer bottom panel;

at least one security compartment in said storage area;

a front plate mounted on the outer surface of said front wall, said front plate having a horizontal slot formed therein, said slot providing access to said security compartment when said cash drawer is in a closed position;

a cover plate overlying and enclosing said security compartment;

a key lock on said cover plate for controlling access to said security compartment when said till is removed from said support surface;

said cover plate has an upwardly inclined front portion that extends forwardly from a generally flat horizontal portion that overlies and encloses said security compartment, said inclined front portion being positioned axially inline with and immediately above a top edge of said horizontal slot to direct items passed through said slot into said enclosed security compartment; and a frontwall of said security compartment having an upwardly inclined forward portion which is generally parallel to the upwardly inclined front portion of said cover plate and positioned immediately below a bottom edge of said slot to form a downwardly inclined passageway from said horizontal slot that communicates with the interior of said security compartment.

11. The cash drawer of claim 10 wherein said frontwall of said security compartment has a lower portion that extends upwardly from the bottom panel, said lower portion including a pair of slots sized and spaced to receive a pair of lugs on a lower surface of said inclined front end of said cover plate.

12. The cash drawer of claim 11 wherein said cover plate is pivotally connected to the front wall of said security compartment.

13. The cash drawer of claim 12 wherein said cover plate is detachably connected to said frontwall of said security compartment.

14. The cash drawer of claim 10 wherein the security compartment has an interior width generally corresponding to the width of said horizontal slot.

15. A secured storage compartment for use in a cash drawer, comprising:

a tray having a pair of sidewalls, a backwall and a frontwall;

said storage compartment being sized to be received in a cash drawer below a till contained therein adjacent to forward end of said cash drawer;

a cover plate extending from said backwall to said frontwall between said sidewalls, said cover plate having an inclined front portion that extends forwardly from a generally flat horizontal portion that overlies and encloses said security compartment;

said frontwall having an upwardly inclined top portion which is generally parallel to the outwardly inclined portion of said cover plate forming a downwardly inclined passage into the interior of said security compartment, the entry to said passageway being positioned so that it is in communication with a receiving slot in a front face of the cash drawer in which the security compartment is contained;

said cover plate being detachably connected to the frontwall of said security compartment; and a lock on said cover plate for controlling access to said security compartment.

16. The security storage compartment of claim 15 wherein said cover plate is detachably connected to the frontwall of said security compartment.

17. The secured storage compartment of claim 15 wherein said lock is a key lock which includes a deadbolt that is received in a slot in the backwall.

* * * * *